US008141487B2

(12) United States Patent
Lefken et al.

(10) Patent No.: US 8,141,487 B2
(45) Date of Patent: Mar. 27, 2012

(54) PRINTING PRESS HAVING AN ANILOX INKING UNIT WITH AN ASSOCIATED WASHING DEVICE

(75) Inventors: Wilhelm Lefken, Dossenheim (DE); Jürgen Michels, Dossenheim (DE); Dieter Schaffrath, Lorsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 364 days.

(21) Appl. No.: 12/364,043

(22) Filed: Feb. 2, 2009

(65) Prior Publication Data

US 2009/0193988 A1 Aug. 6, 2009

(30) Foreign Application Priority Data

Jan. 31, 2008 (DE) ..... 10 2008 007 038

(51) Int. Cl.
*B41F 35/00* (2006.01)

(52) U.S. Cl. ..... 101/423; 101/424

(58) Field of Classification Search ..... 101/424, 101/423

See application file for complete search history.

(56) References Cited

U.S. PATENT DOCUMENTS

| | | | | |
|---|---|---|---|---|
| 5,341,733 | A * | 8/1994 | Weisbrod | 101/148 |
| 5,452,660 | A * | 9/1995 | Stein | 101/425 |
| 6,196,128 | B1 * | 3/2001 | Corrado et al. | 101/425 |
| 6,378,427 | B1 * | 4/2002 | Endisch | 101/349.1 |
| 6,460,455 | B1 * | 10/2002 | Eltner et al. | 101/148 |
| 6,546,869 | B1 * | 4/2003 | Eltner et al. | 101/483 |
| 6,745,689 | B2 * | 6/2004 | Franklin et al. | 101/216 |
| 7,373,882 | B2 | 5/2008 | Heuschkel et al. | |
| 7,677,174 | B2 * | 3/2010 | Eckel et al. | 101/483 |
| 2004/0050277 | A1 * | 3/2004 | Stanka | 101/425 |
| 2007/0266873 | A1 | 11/2007 | Eckel et al. | |

FOREIGN PATENT DOCUMENTS

| | | | |
|---|---|---|---|
| DE | 1 090 682 | | 10/1960 |
| DE | 101 48 501 | A1 | 4/2003 |
| DE | 10 2005 056 812 | A1 | 6/2006 |
| DE | 10 2007 009 969 | A1 | 11/2007 |
| WO | 03/031184 | A1 | 4/2003 |

OTHER PUBLICATIONS

German Patent and Trademark Office Search Report, dated Jun. 10, 2008.

* cited by examiner

*Primary Examiner* — Anthony Nguyen
(74) *Attorney, Agent, or Firm* — Laurence A. Greenberg; Werner H. Stemer; Ralph E. Locher

(57) ABSTRACT

A printing press includes an anilox inking unit having an engraved roller and a washing device with a feed device for introducing detergent and a removal device for removing the detergent and printing ink. Further rollers are disposed between the feed device and the engraved roller and between the engraved roller and the removal device, as viewed in a conveying direction of the detergent. An effective length of the further rollers increases from the feed device to the removal device.

8 Claims, 2 Drawing Sheets

PRINTING PRESS HAVING AN ANILOX INKING UNIT WITH AN ASSOCIATED WASHING DEVICE

CROSS-REFERENCE TO RELATED APPLICATION

This application claims the priority, under 35 U.S.C. §119, of German Patent Application DE 10 2008 007 038.6, filed Jan. 31, 2008; the prior application is herewith incorporated by reference in its entirety.

BACKGROUND OF THE INVENTION

Field of the Invention

The present invention relates to a printing press having an anilox inking unit and an associated washing device.

German Published, Non-Prosecuted Patent Application DE 10 2005 056 812 A1, corresponding to U.S. Patent Application Publication No. US 2006/130680 A1), discloses a printing press which includes an anilox inking unit having an engraved roller and a washing device which has a feed device for introducing detergent and a removal device for removing the detergent and printing ink and further rollers disposed between the feed device and the engraved roller and between the engraved roller and the removal device, as viewed in a conveying direction of the detergent. The feed device has a spraying device and the removal device has a cleaning doctor. In that printing press, liquid rings made from the printing ink/detergent mixture can form in a cleaning mode on both ends of the circumferential surface of the engraved roller. The liquid rings spray off or drip off and can cause complications, such as the contamination of adjacent machine parts.

German Published, Non-Prosecuted Patent Application DE 101 48 501 A1, corresponding to International Publication No. WO 03/031184 A1, describes a printing press, in which intermediate rollers have a stepped length, with the result that ink rings which build up at ends of roller cover surfaces are rolled over by the respectively next longest intermediate roller, with the result that ink splatters are avoided. Starting from a reference roller, the length of the intermediate rollers decreases in a stepped manner, with the result that, starting from the reference roller, each intermediate roller transfers the ink onto a shorter intermediate roller or ink applicator roller which is disposed behind it in each case.

However, that does not solve the above-mentioned problem of the contamination of adjacent machine parts by detergent/printing ink mixture which sprays off from the engraved roller, in which the contamination occurs in the cleaning mode of an anilox inking unit.

SUMMARY OF THE INVENTION

It is accordingly an object of the invention to provide a printing press having an anilox inking unit with an associated washing device, which overcomes the hereinafore-mentioned disadvantages of the heretofore-known devices of this general type and in which contamination caused by a cleaning mode is largely avoided.

With the foregoing and other objects in view there is provided, in accordance with the invention, a printing press, comprising an anilox inking unit including an engraved roller and a washing device having a feed device for introducing a detergent and a removal device for removing the detergent and printing ink. Further rollers are disposed between the feed device and the engraved roller and between the engraved roller and the removal device, in a detergent conveying direction. The further rollers have an effective length increasing from the feed device to the removal device.

In the printing press according to the invention, the effective roller lengths of the rollers which are disposed in front of and behind the engraved roller are stepped along the detergent conveying path in such a way that a uniform distribution of the detergent which is introduced into the anilox inking unit and uniform transport away of the detergent/printing ink mixture from the anilox inking unit are ensured.

In accordance with another feature of the invention, the feed device has a spraying device.

In accordance with a further feature of the invention, the further rollers include at least two rollers which are disposed between the spraying device and the engraved roller. In this case, the at least two rollers, which are disposed between the spraying device and the engraved roller, can include an ink applicator roller and a roller which bears against the ink applicator roller.

In accordance with an added feature of the invention, the removal device has a cleaning doctor. In this case, the further rollers can include at least two rollers which are disposed between the engraved roller and the cleaning doctor.

In accordance with an additional feature of the invention, the at least two rollers, which are disposed between the engraved roller and the cleaning doctor, include an oscillating roller, the effective length of which is determined by the oscillating width.

In accordance with a concomitant feature of the invention, the at least two rollers, which are disposed between the engraved roller and the cleaning doctor, include a rubber-covered roller which bears against the engraved roller and the oscillating roller and the effective length of which is determined by the length of its roller barrel. In this case, the rubber-covered roller can be at a standstill axially.

Other features which are considered as characteristic for the invention are set forth in the appended claims.

Although the invention is illustrated and described herein as embodied in a printing press having an anilox inking unit with an associated washing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
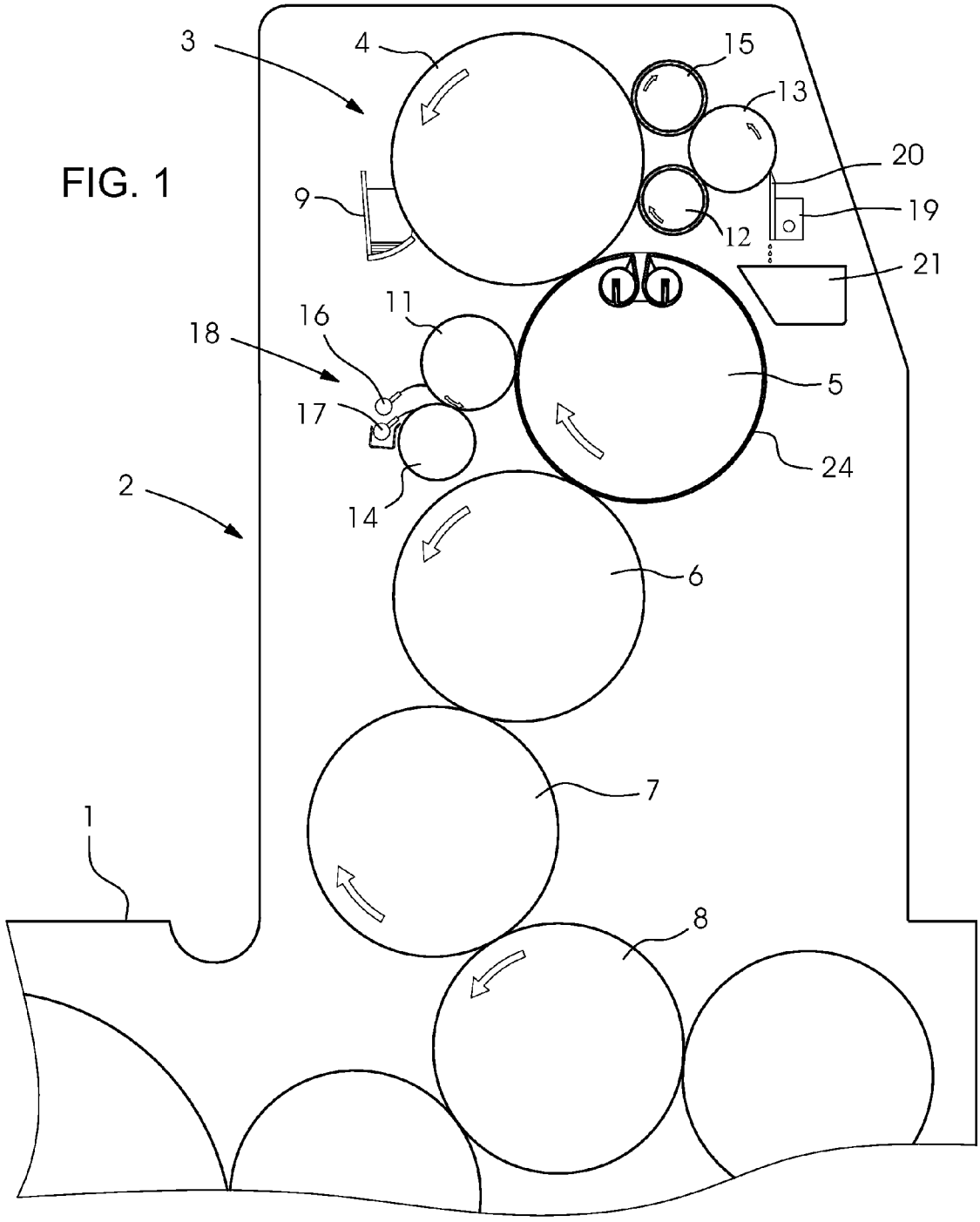
FIG. 1 is a fragmentary, diagrammatic, longitudinal-sectional view of an anilox inking unit.

Referring now to the figures of the drawings in detail and first, particularly, to FIG. 1 thereof, there is seen a printing press 1 having a printing unit 2 for lithographic offset printing. The printing unit 2 includes an anilox inking unit 3 with an engraved roller 4 and an ink applicator roller 5. Furthermore, the printing unit 2 includes a printing form cylinder 6, a blanket cylinder 7 and an impression cylinder 8. During printing operation, the ink applicator roller 5 rolls on the printing form cylinder 6 and sheets which are to be printed are transported on the impression cylinder 8.

An ink feed device 9 bears against the engraved roller 4, in order to feed printing ink to the latter. The ink feed device 9 includes an ink storage chamber, from which the printing ink is fed to the engraved roller 4, and a metering doctor which strips excess printing ink from the engraved roller 4.

In a cleaning mode, a first roller 11 bears against the ink applicator roller 5 and a second roller 12 bears against the engraved roller 4 and against a third roller 13. In this case, a fourth roller 14 bears against the first roller 11 and a further roller 15 can bear against the engraved roller 4 and the third roller 13. The second roller 12 and the optionally present further roller 15 are rubber-covered rollers, that is to say rollers which are fitted with elastomeric roller covers. The third roller 13 is an oscillating roller which performs an axial movement back and forth.

A first spraying device 16 is disposed for spraying detergent onto the first roller 11, and a second spraying device 17 is disposed for subsequently spraying rinsing water onto the fourth roller 14. The spraying device 16 forms a feed device 18 for feeding the detergent.

The first roller 11 is an intermediate roller which is disposed between the feed device 18 and the ink applicator roller 5, and bears against the ink applicator roller 5 behind the printing form cylinder 6 and in front of the engraved roller 4, as viewed in the rotational direction of the ink applicator roller 5.

A removal device 19 for removing a detergent/printing ink mixture bears against the third roller 13. The removal device 19 includes a cleaning doctor 20 which strips the detergent/printing ink mixture from the third roller 13, and a collecting trough 21 for collecting the mixture which has been stripped off.

The cleaning functions as follows: the detergent which is sprayed onto the first roller 11 is metered in a roller nip which is formed by the first roller 11 together with the fourth roller 14, and is transferred in the form of a uniform film from the first roller 11 onto the ink applicator roller 5. The detergent is transferred from the ink applicator roller 5 onto the engraved roller 4. In this case, the ink feed device 9 is thrown off from the engraved roller 4 and the ink applicator roller 5 can be thrown off from the printing form cylinder 6. The detergent which is applied to the ink applicator roller 5 and the engraved roller 4 releases the ink residues from the rollers 4, 5. The ink residues are subsequently removed from the engraved roller 4 by the second roller 12 and, if present, the further roller 15, and transferred onto the third roller 13.

Figure 2:
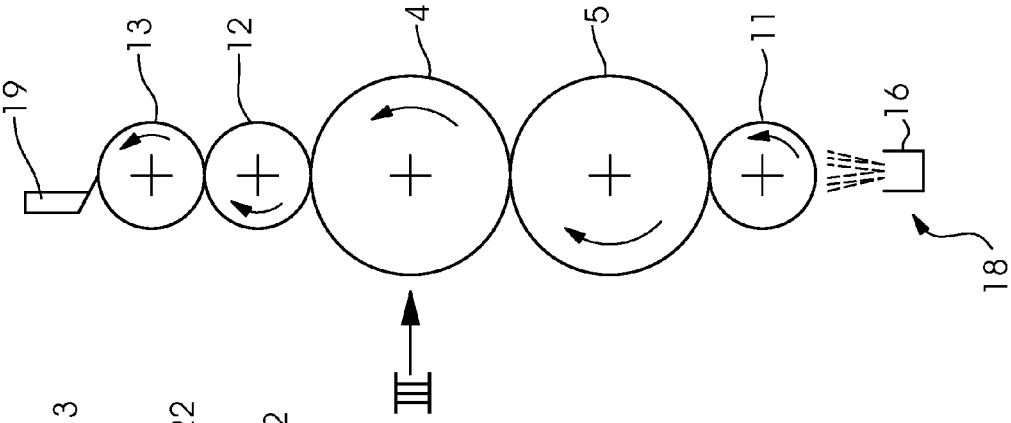
FIG. 2 is an end-elevational view of a roller train of the anilox inking unit.

FIG. 2 shows a diagrammatic illustration of the roller train which is formed by the rollers 4, 5, 11, 12 and 13, with the rollers being shown as lying along a straight center point line for reasons of improved clarity, that is to say the actual circumferential angles which are shown in FIG. 1 between the contact points of the rollers are disregarded.

Figure 3:
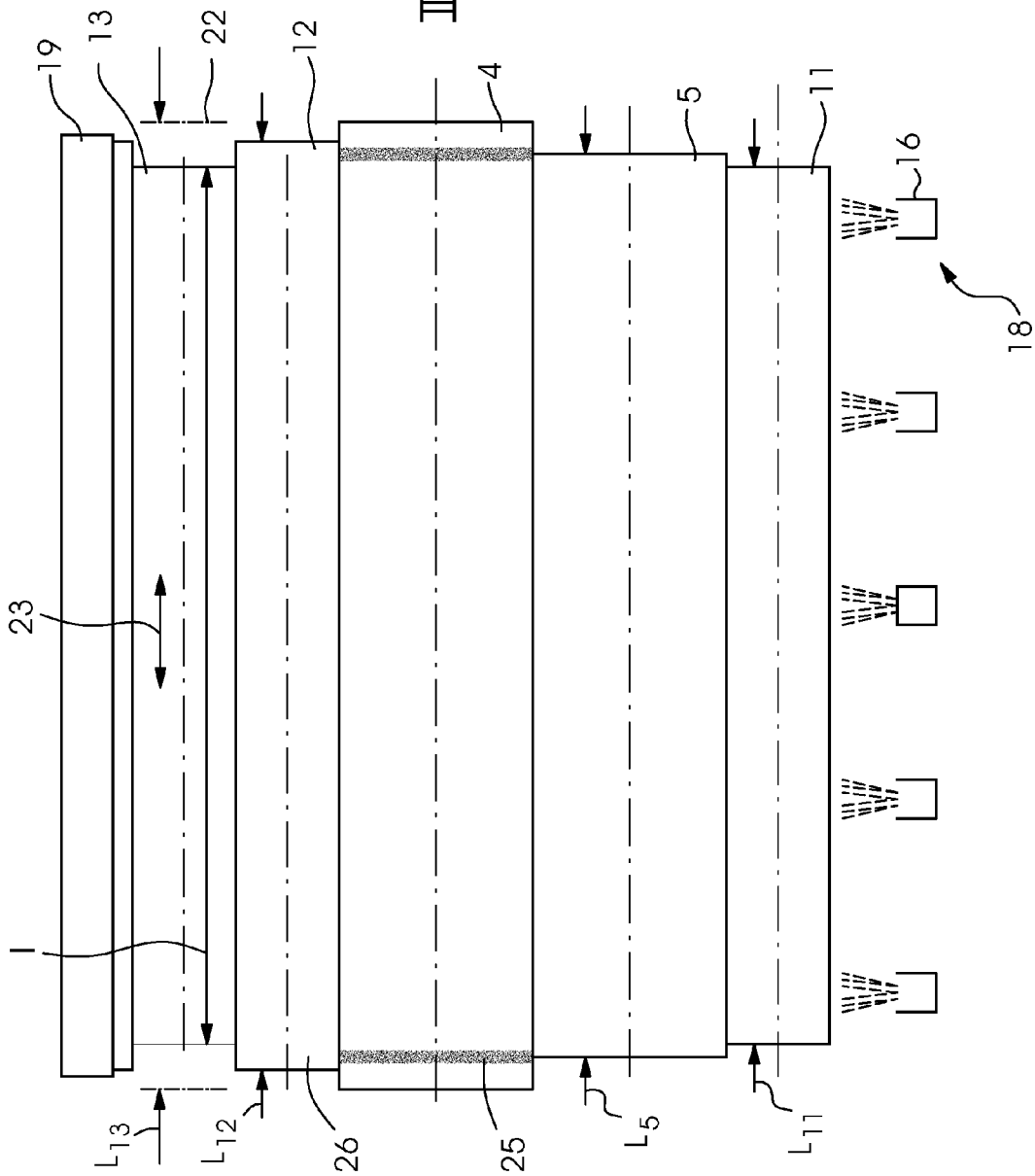
FIG. 3 is a side-elevational view of the roller train as seen in a viewing direction III in FIG. 2.

FIG. 3 shows a lateral illustration of the roller train of FIG. 2. This illustration shows the effective roller lengths of the rollers 5, 11, 12 and 13 which are indicated symbolically by way of dimension arrow heads. The engraved roller 4 has the greatest axial length of all of the rollers of the roller train. An effective length $L_{11}$ of the first roller 11 is determined by the axial length of a roller barrel of the first roller 11. Non-illustrated axle journals are fastened to the roller barrel which is shown in the drawing. An effective length $L_5$ of the ink applicator roller 5 is determined by the axial length of a rubber blanket 24 which is clamped onto the ink applicator roller 5, as seen in FIG. 1. An effective length $L_{12}$ of the second roller 12 is defined by the axial length of a roller barrel 26 of the second roller 12, as is shown in FIG. 3.

An effective axial length $L_{13}$ of the third roller 13 is determined by a spacing which exists between two reversal points or dead centers of an axial oscillating movement 23 of the third roller 13. This spacing is also referred to as an oscillating width $L_{13}$ and is greater than a length l of the roller barrel of the third roller 13.

The effective length $L_5$ of the ink applicator roller 5 is greater than the effective length $L_{11}$ of the first roller 11. The effective length $L_{12}$ of the second roller 12 is greater than the effective length $L_5$ of the ink applicator roller 5. If the further roller 15 (see FIG. 1) is present, it can be structurally identical to the second roller 12, with the result that the effective length of the further roller 15 is likewise greater than the effective length of the ink applicator roller 5. The effective length $L_{12}$ of the second roller 12 is preferably at most 20 mm greater than the effective length $L_5$ of the ink applicator roller 5. The effective length $L_{13}$ of the third roller 13 is greater than the effective length $L_{12}$ of the second roller 12.

As a result of the effective lengths of the rollers which are disposed in front of and behind the engraved roller 5, which effective lengths increase from the introduction location of the detergent to the location where the detergent is doctored off, a generation of liquid rings 25 in axial regions of the engraved roller 4 which are close to the edge and are not rolled over by the ink applicator roller 5, can be avoided or at least minimized to a sufficient extent. Throwing off and dripping off of the detergent/printing ink mixture which forms liquid rings 25 of this type on the engraved roller 5 without the above-described countermeasures and resulting complications, such as contamination of adjacent machine parts, can therefore be avoided. The length gradation of the rollers 5, 11, 12, 13 is selected in such a way that a uniform distribution of the detergent and uniform transporting away of the detergent/printing ink mixture are ensured.

In one modification which is not shown in the drawing, the first roller 11, the fourth roller 14 and the spraying devices 16, 17 which are assigned to the rollers 11, 14 are omitted and there are instead a dampening unit and spraying devices which are assigned to the dampening unit.

The configuration and construction of the dampening unit and the spraying devices which are assigned to the dampening unit are described and shown in the drawing in German Published, Non-Prosecuted Patent Application DE 10 2005 056 812 A1, corresponding to U.S. Patent Application Publication No. US 2006/130680 A1). In this regard, the two above-mentioned documents are incorporated by reference into the disclosure of the present description.

The bridging roller which is present in the modification (see reference numeral 22 in German Published, Non-Prosecuted Patent Application DE 10 2005 056 812 A1, corresponding to U.S. Patent Application Publication No. US 2006/130680 A1) then replaces the omitted first roller 11 in FIGS. 2 and 3. In the cleaning mode, the bridging roller bears against the ink applicator roller 5 and has an effective length which is precisely as great as the effective length $L_{11}$ of the first roller 11. Accordingly, the effective length $L_5$ of the ink applicator roller 5 is greater than the effective length of the bridging roller. The effective length of the bridging roller can be determined solely by the length of its roller barrel and is preferably determined by the oscillating width of the bridging roller, that is to say by the spacing between the two dead centers of an oscillating movement of the bridging roller.

With regard to the remaining features, in particular the stepped gradation of the effective lengths $L_5$, $L_{12}$, $L_{13}$ of the rollers 5, 12, 13, the modification corresponds to the printing press 1 which is shown in FIGS. 1 to 3 and is described in this context.

The invention claimed is:

1. A printing press, comprising:

an anilox inking unit including an engraved roller and a washing device having a feed device for introducing a detergent and a removal device for removing the detergent and printing ink;

first rollers disposed between said feed device and said engraved roller, said first rollers including an ink applicator roller bearing against said engraved roller, said first rollers having stepped effective lengths increasing from said feed device to said engraved roller, and second rollers disposed between said engraved roller and said removal device, said second rollers including a rubber-covered roller bearing against said engraved roller, said second rollers having stepped effective lengths increasing from said engraved roller to said removal device, said effective length of said rubber-covered roller is at most 20 mm greater than said effective length of said ink applicator roller.

2. The printing press according to claim 1, wherein said feed device has a spraying device.

3. The printing press according to claim 1, wherein said first rollers include a roller bearing against said ink applicator roller.

4. The printing press according to claim 1, wherein said removal device has a cleaning doctor.

5. The printing press according to claim 1, wherein said second rollers include an oscillating roller, and said effective length of said oscillating roller is determined by an oscillating width of said oscillating roller.

6. The printing press according to claim 5, wherein said rubber-covered roller bears against said oscillating roller, and said effective length of said rubber-covered roller is determined by a length of a roller barrel of said rubber-covered roller.

7. The printing press according to claim 6, wherein said rubber-covered roller is at a standstill axially.

8. The printing press according to claim 1, wherein said engraved roller, said first rollers, and said second rollers define a roller train, said engraved roller having an axial length being the longest of said rollers of said roller train.

* * * * *